US007431415B2

(12) United States Patent
Hetzer et al.

(10) Patent No.: US 7,431,415 B2
(45) Date of Patent: Oct. 7, 2008

(54) ARRANGEMENT AND METHOD FOR DATA FOLLOW-UP FOR WARMUP CYCLES OF INK JET PRINT HEADS

(75) Inventors: Ulrich Hetzer, Berlin (DE); Jan Keunecke, Kiel (DE); Torsten Schlaaff, Zepernick (DE); George G. Gelfer, West Chester, PA (US)

(73) Assignee: Francotyp-Postalia AG & Co. KG (DE)

( * ) Notice: Subject to any disclaimer, the term of this patent is extended or adjusted under 35 U.S.C. 154(b) by 0 days.

(21) Appl. No.: 10/842,694

(22) Filed: May 10, 2004
(Under 37 CFR 1.47)

(65) Prior Publication Data

US 2004/0212653 A1 Oct. 28, 2004

Related U.S. Application Data

(62) Division of application No. 09/911,811, filed on Jul. 24, 2001.

(30) Foreign Application Priority Data

Jul. 26, 2000 (DE) ..... 100 36 345

(51) Int. Cl.
*B41J 29/38* (2006.01)
*B41J 29/393* (2006.01)
*B41J 2/175* (2006.01)

(52) U.S. Cl. ..... 347/17; 347/19; 347/86

(58) Field of Classification Search ..... 347/17, 347/19, 86, 7, 20
See application file for complete search history.

(56) References Cited

U.S. PATENT DOCUMENTS

| | | | | |
|---|---|---|---|---|
| 4,791,435 | A * | 12/1988 | Smith et al. | 347/17 |
| 4,899,180 | A * | 2/1990 | Elhatem et al. | 347/59 |
| 4,980,702 | A * | 12/1990 | Kneezel et al. | 347/17 |
| 5,075,690 | A * | 12/1991 | Kneezel | 347/17 |
| 5,107,276 | A * | 4/1992 | Kneezel et al. | 347/60 |
| 5,339,098 | A | 8/1994 | Nagatomo et al. | |
| 5,406,315 | A | 4/1995 | Allen et al. | |
| 5,455,606 | A | 10/1995 | Keeling et al. | |

(Continued)

FOREIGN PATENT DOCUMENTS

| | | |
|---|---|---|
| EP | 0 300 634 | 1/1989 |
| EP | 0 440 261 | 8/1991 |
| EP | 0 475 638 | 3/1992 |
| EP | 0 668 165 | 8/1995 |
| EP | 0 903 237 | 3/1999 |

*Primary Examiner*—Stephen D Meier
*Assistant Examiner*—Leonard S Liang
(74) *Attorney, Agent, or Firm*—Schiff Hardin LLP

(57) ABSTRACT

In a method and arrangement for data follow-up for warmup cycles of an ink jet print head, a memory stores warmup data of an ink jet print head and a control unit is provided for the driving the ink jet print head and is programmed to implement at least one measurement of the ambient temperature and to access the memory dependent thereon and dependent on predetermined, stored conditions in order to implement a data follow-up corresponding to the temperature-related, history-related and/or user-related conditions for a fast start. Storage of warmup data and data for a first condition ensues upon new installation of an ink cartridge before the first use thereof, and parameter data for second conditions are determined for a fast start given repeated use, and the appertaining warmup data are computationally or tabularly determined given current second conditions.

9 Claims, 4 Drawing Sheets

U.S. PATENT DOCUMENTS 5,477,246 A 12/1995 Hirabayashi et al.
5,513,563 A 5/1996 Berson
5,548,308 A 8/1996 Nagatomo et al.
5,548,688 A * 8/1996 Wiklof et al. ..... 358/1.8
5,625,384 A 4/1997 Numata et al.
5,673,071 A 9/1997 Fuse
5,710,721 A 1/1998 Rieckhoff et al.
5,714,989 A * 2/1998 Wade ..... 347/14
5,757,402 A 5/1998 Gunther et al.
5,812,156 A 9/1998 Bullock et al.
5,815,180 A 9/1998 Barbour et al.
5,946,007 A 8/1999 Otsuka et al.
5,946,020 A * 8/1999 Rogers et al. ..... 347/193
5,949,444 A 9/1999 Geserich et al.
6,039,430 A 3/2000 Helterline et al.
6,045,206 A 4/2000 Igval
6,126,266 A 10/2000 Numata et al.
6,154,229 A * 11/2000 Corrigan ..... 347/17
6,247,774 B1 6/2001 Mueller
6,302,507 B1 * 10/2001 Prakash et al. ..... 347/14
6,435,668 B1 8/2002 Barbour et al.
6,478,399 B1 11/2002 Mitsuzawa et al.

* cited by examiner

ARRANGEMENT AND METHOD FOR DATA FOLLOW-UP FOR WARMUP CYCLES OF INK JET PRINT HEADS

BACKGROUND OF THE INVENTION

This application is a divisional of copending application Ser. No. 09/911,811, filed Jul. 24, 2001.

1. Field of the Invention

The present invention is directed to an arrangement for data follow-up for a warmup cycle of an ink jet print head. The invention is utilized in ink jet printer devices, for example in a postage meter machine with an ink jet print head, a printing station of a mail processing machine or other printer devices.

2. Description of the Prior Art

German Patentschrift 196 05 015 (U.S. Pat. No. 5,949,444) discloses a printer device of the JetMail® postage meter machine in detail. With a non-horizontal, approximately vertical letter transport, a franking imprint is implemented with an ink jet print head stationarily arranged in a recess behind a guide plate. A trigger sensor for the printing process is arranged shortly before the recess for the ink jet print head, which recognizes the start of the letter and interacts with an incremental sensor for path control. The printing process is triggered by a transmitted light barrier of the JetMail® postage meter machine (European Patent 901 108). The leading edge even of pieces of mail that are especially thick is thus unambiguously recognized. Further optical sensors for recognizing a mail jam and for path control are also utilized in the JetMail® device. In addition to these sensors, at least one sensor for sensing a print block of the print head is utilized, such as a heating resistor, this being likewise connected to the postage meter machine control via an internal interface circuit of the postage meter machine. An internal postage meter machine interface circuit is disclosed in European Patent 716 398 (U.S. Pat. No. 5,710,721). For example, the print block contains three ink printing modules. In conformity with an embodiment disclosed in European Application 713 776 (U.S. Pat. No. 5,757,402), the ink printing modules are arranged between identically constructed circuit modules, the latter respectively carrying a heating resistor and a sensor. In order also to assure a high printing quality of the JetMail® postage meter machine even given a low ambient temperature, the print block, and thus the ink as well, are preheated to a predetermined temperature. Printing is only allowed within a specific temperature range, since the temperature of the ink has a considerable influence on the droplet formation during the ink ejection. When the ambient temperature lies at a temperature $T_{error}$=0° C. below the minimum operating temperature $T_{min}$=32° C. of the JetMail®, damage to the print head can occur due to excessively large temperature differences during heat-up. The printing quality becomes poorer above the maximum operating temperature $T_{max}$=50° C. of the JetMail® system. In both instances, at least one error message is generated. There are thus competing considerations between assuring a high print quality and achieving an immediate readiness of the printer device.

Other ink jet printers or postage meter machines with ink jet printer technology, for example with bubble jet technology, also must reach a predetermined operating temperature before the print block or the printer is enabled for printing. A sensor constantly measures the temperature in the ink print head. The specific warmup data are redetermined for each ink cartridge every time the device is turned on. A repeated spray-rinsing is thereby cyclically implemented and a large ink volume is thus wasted. For the purpose of an ink spraying, it is necessary to electrically heat a heating resistor arranged close to a nozzle such that some of the water of the aqueous ink suddenly evaporates (bubble jet principle). The ink jet print head is driven with print voltage pulses of approximately 12 V and a duration of approximately 1.9-2.3 μs. A drop if ink is thereby accelerated to the surface of a print medium or, if no print medium is present, to the opening of an ink sump container. The local heating also leads to the gradual rise of the temperature in the broader environment of the heating resistor. A printing pause, in contrast, leads to the gradual drop of the temperature. In particular, an ink jet printer connected to a personal computer that is restarted daily requires too long a preparation time for the printing job. Given ½-inch ink jet cartridges, for example, 22 temperature values of the print head that belong to a respective print pulse voltage value are measured after turn-on. Each nozzle is driven one thousand times per measurement with the print pulse voltage value that has been set. In the next measurement, the nozzle is driven a thousand times with a print pulse voltage value that is set lower. The course of the temperature curve measured in this way is interpreted. The print pulse voltage value that is derived is employed for the subsequent printing. The ambient temperature likewise has an influence in the measurement. The preparation time that is thus required then has a predetermined duration of approximately 1 minute.

If, on the other hand, a start could be undertaken proceeding from a standby mode for the ink jet printer, then this could allow an immediate implementation of the print job. The correct operating temperature 15-40° C. is retained when the ink jet print head is operated in the standby mode without printing a print medium. The operating temperature can be maintained during printing given a shorter printing pause or in the standby mode by electrically heating the heating resistor close to each nozzle such that hardly any or no water of the aqueous ink evaporates. An energy pulse of approximately 0.75 μm then suffices only for the warmup (pulse warming-up) but not yet for printing. For achieving a longer service life of the cartridge, the PWU method (pulse warming-up) also is employed after the turn-on. Given an ambient temperature range of 10-40° C., too, a warmup time must elapse if an operating temperature of approximately 45° C. is to be achieved again. A longer time must pass below the indicated range of the ambient temperature. A predetermined operating temperature also can be maintained with a stronger energy pulse that is supplied in time intervals wherein printing is not performed. Although this allows an immediate printing, a stronger energy pulse >2 μs leads to ink spraying. The ink supply of a cartridge, however, is limited to approximately 42 ml and thus also is consumed in the standby mode. Since the ink cartridges hold a far lower ink volume than, for example, the ink tank of the JetMail® postage meter machine, the service life of the ink cartridge would be considerably shortened by each and every additional ink consumption during warmup.

U.S. Pat. No. 5,625,384 discloses an ink jet printer with replaceable ink print heads, whereby the characteristic data of each specific head are determined during the production of the cartridge and stored in the ROM on the head, i.e. before an initial placement in the ink jet printer. The head operating conditions thus can be automatically called. The replacement of a head is automatically recognized on the basis of identification information. An ink jet head that is re-introduced (re-used), however, cannot be operated with the optimum conditions if too long a time interval has passed before the re-introduction. When the re-introduced ink print head has only a residual ink supply available to it, however, a restoration of conditions that guarantee a long service life of the ink print head could be foregone. However, there is no possibility of shortening the time span after the re-introduction until the renewed operation of the head farther, and the latter is always operated with the same data stored during production.

SUMMARY OF THE INVENTION

An object of the present invention is to provide an arrangement and a method for data follow-up for a warmup cycle of an ink jet print head that, with lower ink consumption, fundamentally enable a faster operational readiness and a satisfactory print quality.

The above object is achieved in accordance with the principals of the present invention in a method and arrangement for data follow-up in a warmup cycle of an ink jet print head, wherein a ink jet printhead of an ink cartridge has a drive unit for heating, and measuring the temperature of, and driving the ink jet print head, and a control unit for controlling the drive unit, with a memory accessible by the control unit for storing warmup data for the ink jet printhead. The memory contents can be rewritten, and the memory has a first memory area for storing the aforementioned warmup data and a second memory area for storing predetermined temperature related, history-related and user-related conditions. The control unit is programmed it to implement a least one measurement of the ambient temperature using a sensor, and to determine the warmup data for a warmup cycle dependent on the measured ambient temperature and dependent on the aforementioned predetermined conditions for executing a fast start.

Thus, in the inventive arrangement and method, the print head characteristics are determined in the machine itself and are stored in a recordable memory in order to be able to correspondingly program the machine for the head that is introduced into the machine for the first time. The print head characteristics need not be redetermined in the machine for an ink jet print head that is replaced and reintroduced. Preferably, ink cartridges are utilized that have an ink reservoir, an ink jet print head and a non-volatile memory. Optimum warmup data are determined for different ink cartridges by a control unit of the machine and are stored. Not only the ambient temperature, but also other conditions that can have changed given a later re-employment of an ink cartridge, are inventively taken into consideration. For exaple, an ink cartridge serial number that has been read out can be stored in the memory of a postage meter machine together with appertaining warmup data given a first-time initialization of an ink cartridge, such data being subsequently adaptable to the changed conditions. Additionally or alternatively, the warmup data can be stored on a memory chip of an ink cartridge.

When optimum warmup data have already been determined, a reduction of the warmup cycles at the next activation can ensue by means of:

a temperature-related data follow-up by using a table stored in the memory or by a calculation according to an algorithm stored in the memory;

a history-related data follow-up by using a table stored in the memory or by a calculation according to an algorithm stored in the memory; and/or a user-related data follow-up corresponding to a user input of data into the memory and calling operating parameters dependent on the selection made by the user.

When the warmup data for a specific ink cartridge were stored under first conditions upon initialization thereof, then the appertaining warmup data under second conditions at the next activation can be determined without having to repeatedly measure a physical condition. At least the ambient temperature and the head temperature upon activation are included in a current second condition. When the measured temperature, however, lies between two temperature points in the table, the microprocessor can interpolate in the warmup data. The data follow-up is possible in three combinations:

temperature-related and history-related follow-up;

temperature-related and user-related follow-up; as well as temperature-related and history-related and user-related follow-up.

A postage meter machine or an ink-jet printer allow a user input via a user interface in order to enter a setting selectable in steps between a longer service life of the cartridge or a faster operational readiness (fast start). The time span after the reintroduction until the renewed operation of each cartridge thus has a selectable length dependent on user wishes, but a shorter selected length reduces the service life of the cartridge. The user-related follow-up is related to the current input request. Given the user-related data, the variation of the temperature behavior of the head of the ink cartridge due to the ambient temperature is also considered.

The completed ink consumption/use of every ink cartridge and the aging are history-related conditions that the postage meter machine automatically takes into consideration. Aging occurs not only due to the time duration over which the head is operated but also occurs given non-use. The manufacturer of the postage meter machine stores an expiration date for the ink cartridge in each of the ink cartridges in non-volatile fashion. For example, an internal calender/clock of the postage meter machine can be employed for determining the aging. Before the expiration date, the value (count) of the calender/clock thereof will reduce due to usage of the ink cartridge. It thus seems justified to implement a faster start at the expense of the service life of the ink cartridge.

A determination also can be made as to whether the expiration date for the ink cartridge has passed. In such a case, the controller is programmed to automatically implement a fast start at the expense of the service life of the cartridge that allows the time span until the renewed operation of the cartridge to be shortened to a minimum length.

As an alternative to the expiration date, a number of days can be stored as a limit value in non-volatile fashion in each of the ink cartridges. This is decremented daily until zero is reached. Upon downward transgression of predetermined limit values of days, or when zero is reached, it is enabled to implement a correspondingly faster start at the expense of the service life of the cartridge.

In a further version of the invention, a number of days is stored in non-volatile fashion as a limit value and a counter is incremented daily until a number of days is reached that corresponds to the limit value. Upon upward transgression of predetermined limit values of days, it is again enabled to implement a correspondingly faster start at the expense of the service life of the cartridge.

The modification of the temperature behavior due to usage and aging of the ink cartridge is taken into consideration by means of the history-related data.

This temperature-related, history-related and/or user-related data follow-up employ warmup data that are allocated to the current condition data, such as in a table. The production thereof ensues with sensors and memories, possibly with a clock/date module. The microprocessor of the controller of the printer device implements a determination of the ambient temperature, of the head temperature, the filling level, the time duration for operation of the head up to the current date, as well as the user request and selects warmup data or calculates warmup data.

DESCRIPTION OF THE PREFERRED EMBODIMENTS

Figure 1:
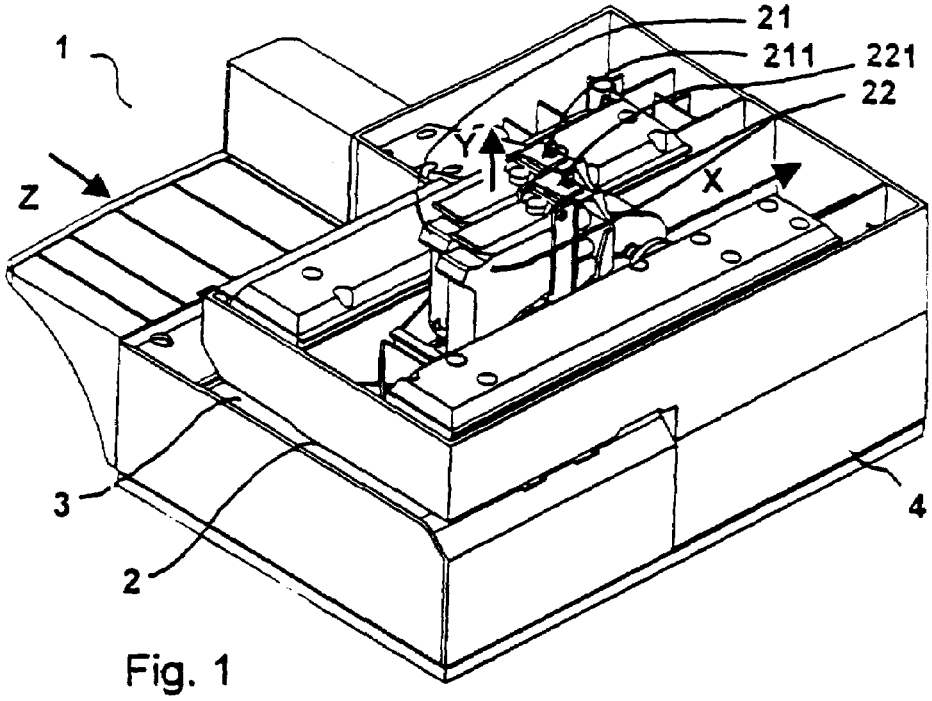
FIG. 1 is a perspective view of a postage meter machine with an ink cartridge therein constructed and operating in accordance with the invention.

FIG. 1 shows a perspective view of a postage meter machine 1 opened at the top. The postage meter machine 1 has a slot-shaped opening 3 in its housing 4. The transport direction for a supplied piece of mail (not shown) is identified by an arrow and proceeds from the upper left to the bottom right. Given further transport, the piece of mail comes to lie against a guide plate 2 of the postage meter machine 1. The housing 4 opened at the top shows two ½ inch ink jet print heads positioned in printing position.

Each print head has its own data memory and ink store and is therefore also referred to as an ink cartridge. An ink storage container holds approximately 40 ml of ink. The connection side of the ½ inch ink cartridges 21, 22 is fashioned in a specific, predetermined way. For electronic signal conversion and electromechanical connection, corresponding control and contacting units 211 and 221 are adapted to the connection side of the ½ inch ink cartridges 21, 22, respectively.

Figure 2:
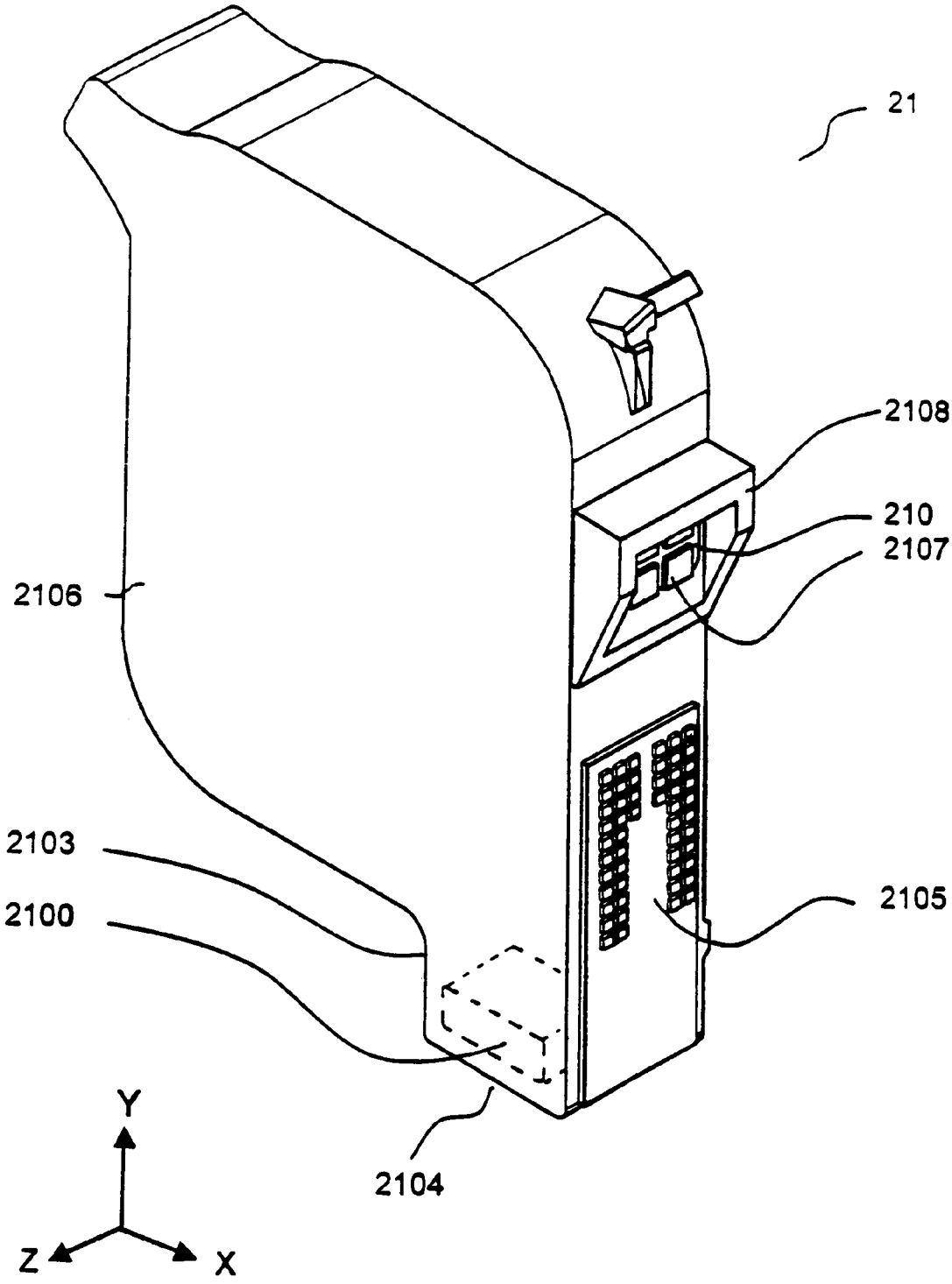
FIG. 2 is a perspective view of an ink cartridge constructed and operating in accordance with the invention.

FIG. 2 shows an ink cartridge 21 that has an electronic semiconductor chip 2100 in a head that is connected to a neck 2103. The head has a nozzle plate 2104 in the ejection direction and—orthogonally thereto—a parallel interface with an electrical contacting unit 2105 for the drive of the ink jet print head. The ink cartridge 21 has a belly-shaped ink reservoir 2106 as an ink store and—lying opposite thereto—an electronic memory chip 210 for storing warmup data of the ink jet print head 21 with electrical contacts 2107 for interrogating the warmup data, the filling level data and other data. The latter data include a manufacturer identification number on the basis of which the control unit of the printer device can check whether a valid ink cartridge 21 has been installed. A mechanical projection 2108 prevents insertion into the printer or device of ink cartridges that are not authorized by the manufacturer of the printer device. The memory chip 210, the contacts 2107 and the projection 2108 are preferably combined in a structural unit and non-releasably secured (for example, by gluing) to the housing wall of the ink cartridge (at the neck or back). The electronic memory chip 210 for storing warmup data has a serial interface with the electrical contacts 2107 for the interrogation of data. A control and contacting unit 211, which mates with the projection 2108 and the contacts 2107 is provided for electronic signal conversion and mechanical connection to the ½ inch ink cartridge.

Figure 3:
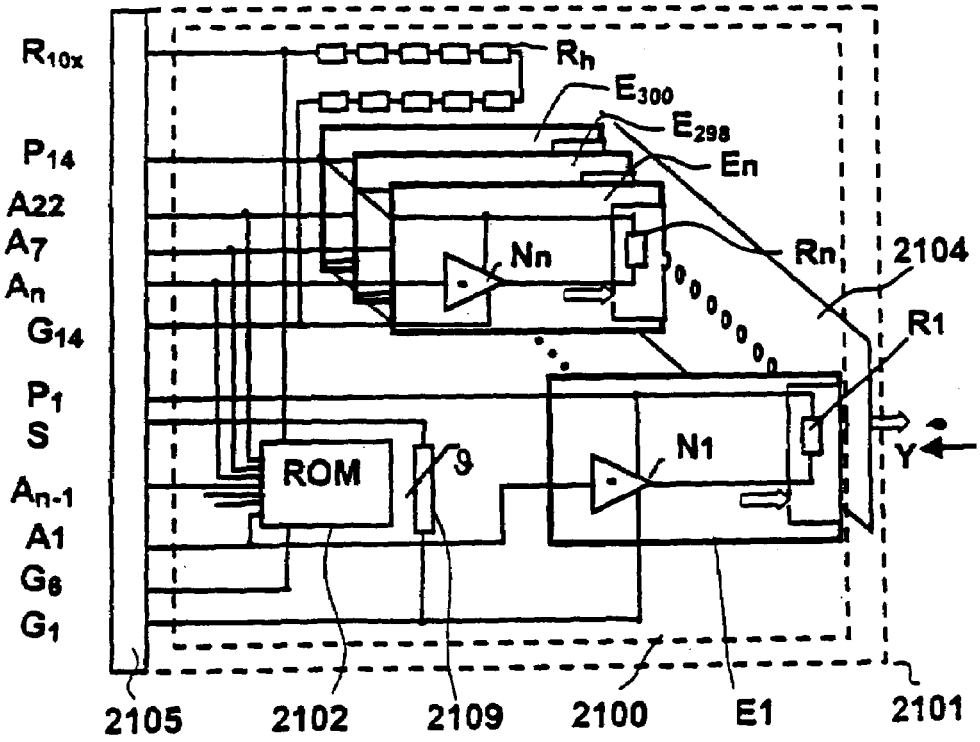
FIG. 3 is a block circuit diagram of the electronic semiconductor chip for the head constructed and operating in accordance with the invention.

FIG. 3 shows a block circuit diagram of the electronic semiconductor chip 2100, which at least has a data memory 2102 for the ink cartridge 21, a sensor 2109 for the head temperature and ink ejectors E1 . . . En . . . E300 in a head 2101. In the bubble jet principle, the ink ejectors respectively contain heating resistors R1 . . . Rn . . . R300, one heating resistor being allocated to each ink chamber and being driven by respective negators N1, . . . , Nn, . . . , N300. The negators N1 . . . , Nn,. . . , N300 are connected to pins for address inputs A1, . . . , An, . . . , pins for power inputs P1, . . . , Pn, . . . , and pins for ground potential G1, . . . , Gn, . . . and can be selected thereby. The pins for ground potential G1, . . . , Gn, . . . and those for the power inputs P1, . . . , Pn, . . . are combined into 14 respective groups for a preselection. For example, 22 ink ejectors E262, E264, . . . , En, . . . , E298, E300 of a head 2101 can be preselected in common via the pins P14 and G14 of the fourteenth group, and 22 ink ejectors E86, E88, . . . , Em, . . . , E1216, E128 of the head 2101 can be preselected in common via the pins P6 and G6 of the sixth group. The pins for address inputs A1 through A7, A9 through A14 and A16, . . . , An, . . . , A22 are combined to form 20 address inputs A1, . . . , An, . . . , A22 that allow the 20 ink ejectors E262, E264, . . . , En, E298, E300 of the fourteenth group of the head 2101 to be individually selected. The pins for address inputs A1, . . . , An, . . . at the other groups are combined to a maximum of 22 address inputs A1, . . . , An, . . . , A22 in order to be able to individually select the 22 ink ejection means, for example of the sixth group. With 50 contacts of the contacting unit 2105, thus, more than 300 dots can already be addressed. The memory cells of a read-only memory 2102 (ROM) also can be individually addressed via the 22 address inputs A1, . . . , An, . . . , A22. The word width of the ROM 2102 amounts to 1 bit that can be interrogated via the pins R10x, G6 in order, for example, to interrogate the type (1 bit), the serial number of the ink cartridge (8 bits) and, as needed, other data (13 bits). Each memory cell is constructed similarly to the circuit for ink ejection. Each cell has a negator with an FET and a drain resistor. The latter is mask-programmed and can be connected in parallel with a reference resistor when the pins G14 and G6 are connected. The interrogation of a resistance reference value ensues via the contact pin R10x when G14 is selected. A further contact pin S is provided for the interrogation of the head temperature sensor. The contacting unit 2105 connected to the head 2101 has a total of 52 contacts (FIG. 2).

Figure 4:
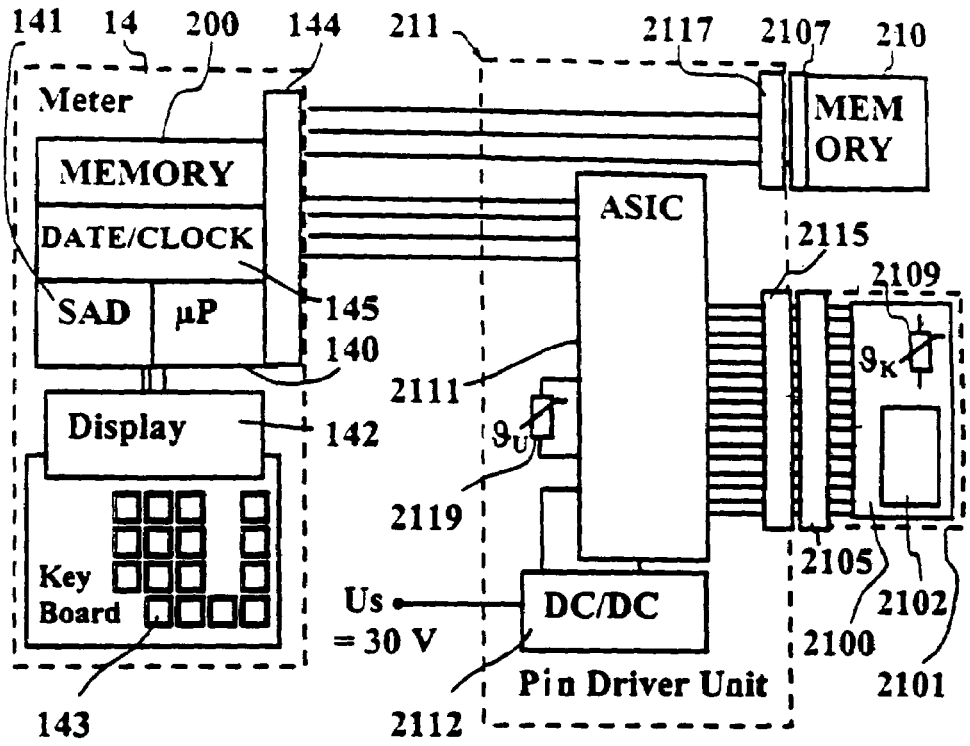
FIG. 4 is a block circuit diagram with a contacting unit and the electronic control unit of the printer device constructed and operating in accordance with the invention.

FIG. 4 shows a block circuit diagram with a control and contacting unit 211 (pin drive unit) and the electronic control unit of the printer device. The control unit 14 of the printer device 1 has at least one microprocessor 140, user interfaces 142, 143, a memory 200, a serial interface 144 and a clock/date module 145. For example, the control unit 14 can be for a postage meter machine and also can contain a secure accounting device 141 for reckoning frankings. The control unit 14 is connected to the memory 200. Via a contacting unit 2117 of the control and contacting unit 211, the control unit 14 is connected to the contacting unit 2107 of the memory 210 via a serial interface 144. The memory 210 is, for example, an $E^2$PROM or similar non-volatile write/read memory. The control and contacting unit 211 contains an application-specific integrated circuit (ASIC) 2111 and a temperature sensor 2119 for determining the ambient temperature. The ink jet print head temperature from the sensor 2109 and an 8-bit ink cartridge serial number from the read-only memory 2102 (ROM) can be interrogated via the contacting unit 2115 of a parallel interface of the ASIC 2111 of the control and contacting unit 211. This read-only memory 2102 supplies the 8-bit ink cartridge serial number to the contacting unit 2105 of the parallel interface of the semiconductor chip 2100 that is connected to the contacting unit 2115 of the parallel interface of the ASIC 2111. The data stored in the memories 200 and 210 are called by the microprocessor 142 and the head temperature determined via the sensor 2109 is interrogated. The ASIC 2111 of the control and contacting unit 211 receives serial signals that are now supplied by the control unit 14 of the printer device 1 so that these can be converted into parallel drive signals for the electronic semiconductor chip 2100. Controlled by the ASIC 2111, a voltage converter (DC/DC) 2112 generates the print voltage at the required amplitude.

A second control and contacting unit 221 (not shown) for the second ink cartridge 22 is fundamentally constructed the same as the control and contacting unit 211 for the first ink cartridge 21.

Alternatively, a common print control unit (not shown) is also possible that contains an ASIC 2011 and a voltage converter (DC/DC) 2012 and to which two contacting units 211 and 221 can be plugged. The common print control unit 20 is driven by the control unit 14. A potential difference between the two ink cartridges 21 and 22 with respect to the drive pulse energy is then compensated with a modified pulse duration given the same pulse amplitude.

In accordance with the inventive method, storage of warmup data under first conditions ensues, and second conditions are determined, and the appertaining warmup data are determined given current second conditions. The $E^2$PROM 210 arranged on the ink cartridge 21, 22 or a comparable nonvolatile memory is provided for storing warmup data in a first memory area and the ink cartridge serial number in a second memory area, the latter being identical to the ink cartridge serial number stored in the memory ROM 2102. The microprocessor 140, for example, accesses the first memory area of the memory 200 or 210, with the warmup data using the ink cartridge serial number from the ROM 2102. A manufacturer identification number of the manufacturer supplying the printer device 1 and ink cartridges 21, 22 can be present stored in the memories 200 or 210. The manufacturer identification numbers of all ink cartridges 21, 22 are identical. The authorization to employ the ink cartridges 21, 22 can be checked by the microprocessor 140 on the basis of the manufacturer identification number that is present stored in a memory area of the memory 140. The form of the contacts 2107, the nature of the interface (serial) and the mechanical projection 2108 additionally limit the attempted use of ink cartridges of a different manufacturer without authorization. The correctness of all code or numbers can, for example, be checked by a remote data center. German Patent Application Number 199 58 941 discloses a method for protecting a device against operation with unapproved consumables and an arrangement for the implementation of the method, whereby a code is allocated to the ink cartridge and the check of the authenticity of the ink cartridge ensues in a remote data center on the basis of a stored reference code word.

The storage of warmup data under first conditions ensues in a known way upon initial installation of the ink cartridge, and the check of the authenticity of the consumable (ink cartridge) can be triggered at the same time in a remote data center, namely on the basis of the manufacturer identification number and the 8-bit ink cartridge serial number or, alternatively, on the basis of a code word read out from the memory 210 by comparison to a reference code word stored in a remote data center. The code word can also be formed by encryption of serial and identification numbers or is merely allocated to the serial number. Although the communication with the remote data center can be tapped into, it cannot be interpreted in order to generate counterfeit ink cartridges with a true ink cartridge serial number and manufacturer identification number.

Figure 5:
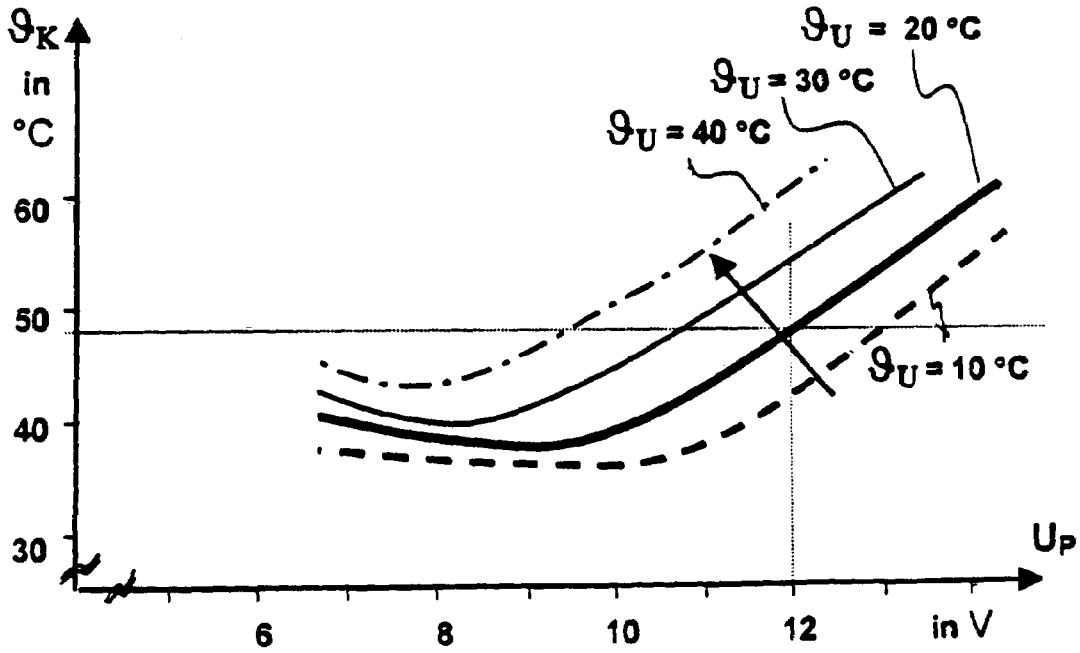
FIG. 5 is a temperature/voltage diagram for explaining the invention.

On the basis of FIG. 5, which shows a temperature/voltage diagram, the determination of the warmup data under first conditions given initial installation of the ink cartridge shall now be explained. A precondition is that the ambient temperature $\vartheta_U$ measured by the control and contacting units 211, 221 (pin driver unit) lies in the optimum range, and that, after calibration has ensued, the head temperature $\vartheta_K$ can be measured by a temperature sensor of the print head. Given ½ inch ink jet cartridges, for example, 22 temperature values of the print head are measured after turn-on, these belonging to respectively predetermined print pulse voltage values. Each nozzle is driven a thousand times with a pulse voltage of ≧12 V given an approximately 2 μs pulse width. The print pulse voltage value is reduced in steps before every further measurement. The measured temperature curve is interpreted by seeking the local minimum of the temperature curve. The appertaining print pulse voltage $U_P(\vartheta_{Kmin})$ is multiplied by a factor of 1.3. The optimum print pulse voltage value that derives is employed for the printing and for the warmup. During warmup, however, the pulse width is reduced to approximately 0.75 μs. The optimum print pulse voltage value and the measured voltage temperature curve are nonvolatilely stored. In the aforementioned example, one temperature/voltage curve is stored as 22 measured values in a first memory area upon new installation of an ink cartridge given a parameter (ambient temperature $\vartheta_U$=20° C.). The ink cartridge is automatically evaluated as new with a further parameter $n_o$ if history-related data are not yet known. The equations $$U_{Popt}=1.3U_P(\vartheta_{Kmin}) \quad (1)$$

$$U_{Popt}=F\{\vartheta_U, \vartheta_{Kmin}, n_o\} \quad (2)$$

can be erected for the optimum print pulse voltage $U_{Popt}$, whereby the function F is determinant for the course of the curve. When other conditions prevail at the next activation (for example, $\vartheta_U$=25° C.), a renewed measurement of a temperature/voltage curve can be inventively foregone since a $U_{Popt}$ determination is undertaken instead by a data follow-up on the basis of the temperature/voltage curve.

There are two fundamental possibilities for a data follow-up:

a) empirically determined data for an optimum print pulse voltage $U_{Popt}$ at different ambient temperatures $\vartheta_U$ referenced to first conditions $n_o$ are stored in a Table 1.

b) algorithm for calculating the optimum print pulse voltage $U_{Popt}$ given different ambient temperatures $\vartheta_U$ referenced to first conditions $n_o$ (see Equation (1)).

Table 1 was registered for a new print head having the serial number 256 and corresponds to the diagram shown in FIG. 5. Beginning from a maximum value of 12 V, the voltage is reduced in steps. The step width amounts to 0.2 V. The minimums $\vartheta_{Kmin}$ are emphasized with bold face.

TABLE 1

| | $U_p$ in V | | | | | | | | | | |
|---|---|---|---|---|---|---|---|---|---|---|---|
| $\vartheta_U$ | 12 | 11.8 | 11.6 | ··· | 10.2 | ··· | 9.4 | ··· ··· ··· | 8.4 | ··· | 8.0 |
| 10° C. | 42° | 41.5° | 41° | | 46° | | 46° | | 46.5° | | 47° |
| 20° C. | 48° | 47.5° | 46° | | 41° | | 37.5° | | 38° | | 39° |
| 30° C. | 55° | 54° | 52° | | 46° | | 43° | | 40° | | 40.1° |
| 40° C. | 60° | 59° | 58° | | 53° | | 48° | | 42.5° | | 42° |
| $U_{Popt}$ in V | | | | | 13.2 | | 12.2 | | 10.9 | | 10.4 |

In the case of empirically determined data and an ambient temperature placed therebetween, intermediate values that are not stored can be determined for the appertaining print pulse voltage by using a standard interpolation calculation. The print pulse voltage belonging to the ambient temperature is multiplied by a factor of 1.3 and yields the optimum print pulse voltage (emphasized with bold face).

For a print head that is not new, second conditions are to be additionally determined as a combination of parameters that enable a history-related and user-related adaptation in that further tables are produced dependent on the parameter $n_P$, $O_{user}$. The second conditions (print head age, filling level) are expressed by the history-related parameter $n_P$. In the simplest case, there is one second table since a distinction is only made between new (parameter $n_o$) and old (parameter $n_P$). The user-related parameter $O_{user}$ generates a further adaptation for what is still a fast operational readiness. In the simplest case, there is only a third and fourth table, since a distinction is made between only two cases, normal and faster.

| Parameter | $n_0$ | $n_P$ | $n_o$, $O_{user}$ | $n_P$, $O_{user}$ |
|---|---|---|---|---|
| Table | 1 | 2 | 3 | 4 |

Figure 6:
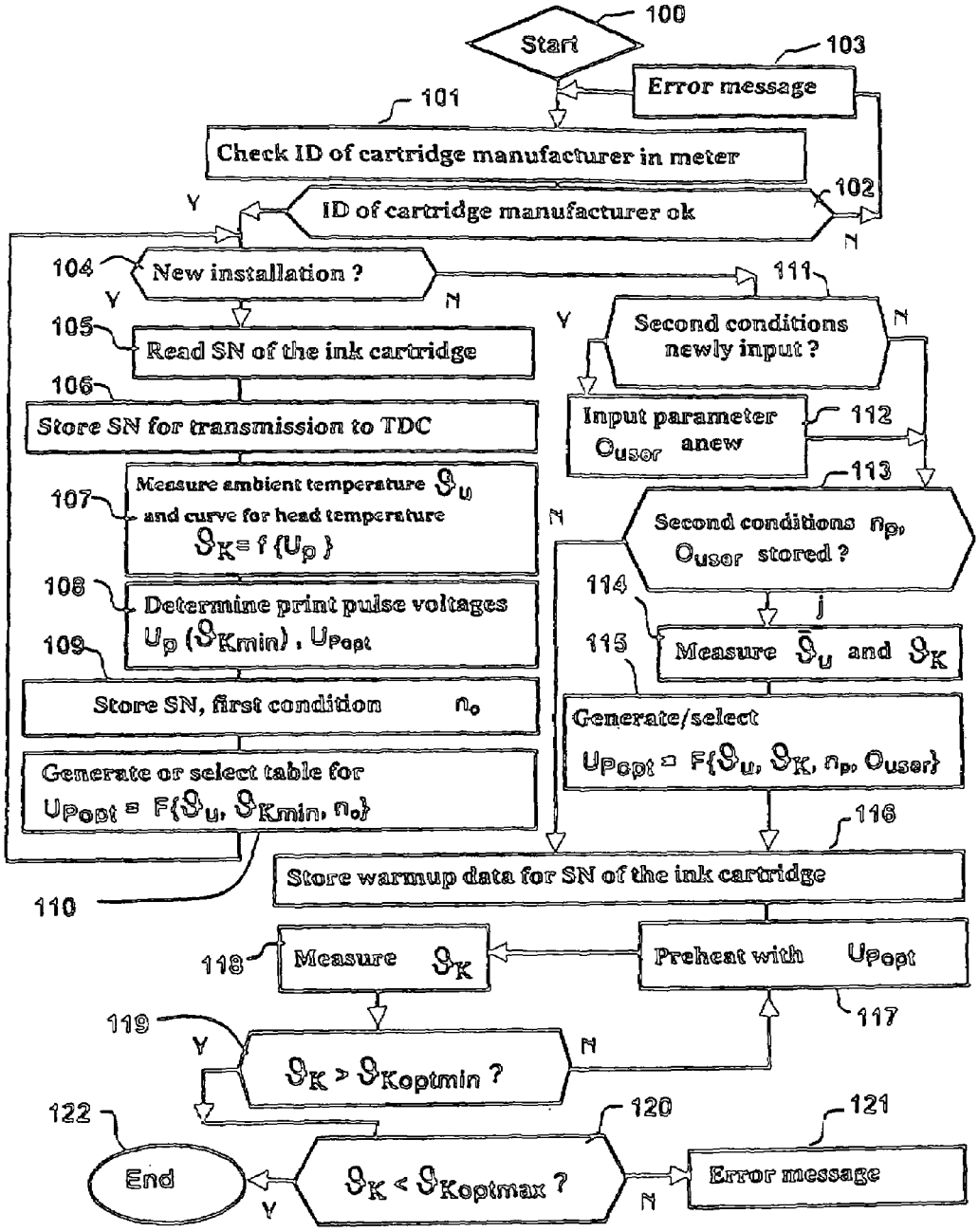
FIG. 6 is a flowchart of the data follow-up for warmup cycles of an ink jet print head constructed and operating in accordance with the invention.

The flowchart for the data follow-up for warmup cycles of an ink jet print head proceeds from FIG. 6. After the start step 100, the control unit 14 preferably reads (step 101) and checks (step 102) the identification number ID of the cartridge manufacturer. A branch is made to the step 104 given a permitted cartridge manufacturer. Otherwise, a branch is made back to the step 101 via step 103 to output an error message. The quality is thus assured since only the cartridges of a specific manufacturer are accepted. A check is carried out in step 104 to determine whether a reinstallation of an ink cartridge should ensue. Ink cartridges that have already been used and replaced in the interim can also be reintroduced. Warmup data with parameter $n_o$, the first condition and, possibly, a code word are already stored for such a non-new ink cartridge. The control unit 14 has a security module 141 that is capable of forming a code (word) by encryption of serial number and manufacturer identification number. The code word is stored in the respective memories, such as the memory 210 of the ink cartridges 21, 22. When a code word or the parameter $n_o$ is stored, no reinstallation is undertaken and a branch is made to the step 111 in order to implement a data follow-up for a fast start in following steps. Up to 256 different serial numbers with allocated warmup data and parameters can be stored in a memory 200 of the postage meter machine. The need for memory space can be reduced the more data (code, serial number and allocated warmup data and parameters) there are that are stored in the respective memories of the ink cartridges themselves.

When a new installation is to be undertaken, then the serial number is read first in the step 105 and the generation of a code that is allocated at least to the serial number potentially ensues. After reading the serial number in step 105, a branch is made to step 106 in order to trigger the automatic communication of the code or of the serial number to the telepostage data center TDC. The communication alternatively can ensue later, for example given a communication for the purpose of a recrediting. An acquisition of the consumable that has been introduced and a check of the code of the serial number ensue in the TDC. The ink cartridge of the specific manufacturer with the serial number that has been read must in fact have been supplied to the user. Otherwise, measures for protection against pirated products can be undertaken. Given a new installation, the ambient temperature $\vartheta_U$ is measured and a curve for the head temperature $\vartheta_K=f\{U_P\}$ is determined in the step 107, the latter being a function of the print pulse voltage $U_P$ applied to the heating elements. A minimum of the head temperature $\vartheta_{Kmin}$ lies in the range $12\ V \geqq U_P \ldots \geqq U_{Pmin}$. The print pulse voltage $U_P(\vartheta_{Kmin})$ that is allocated to the minimum is determined in step 108. The optimum print pulse voltage is then determined according to the aforementioned Equation (1) and stored in the first memory area of the memory 200 or 210. Storage of the serial number or the code and the first conditions $n_o$ in the second memory area of the memory 200 or 210 ensues in step 109. In the following step 110, a first table for the optimum print pulse voltage is selected dependent on the parameters or generated according to Equation (2).

From step 110, a branch is made via step 104 to step 111, where an interrogation is started as to whether second conditions were newly input. This would not be the case given a new installation, and branch is made to step 113, where an interrogation is started as to whether second conditions are present stored. When a parameter $O_{user}$ to the effect that a fast operational readiness should be produced was input and stored user-related at a previous time, a branch is made to a step 114. This is usually not the case given a new installation and a branch is made to step 116, where warmup data are stored allocated to the serial number of the ink cartridge. A pre-heating with pulses having the duration t=0.75 μs and an amplitude $U_{Popt}$ can thus be undertaken in step 117. The head temperature repeatedly measured in step 118 is monitored (steps 119, 120). If it is found in step 119 that a minimum of the optimum head temperature has not been downwardly transgressed, a check ensues in step 120 to determine whether a maximum of the optimum head temperature range has been exceeded. If the head temperature lies within the optimum head temperature range, then the end (step 122) is reached. If, however, the head temperature lies below the optimum head temperature range, then $\vartheta_K > \vartheta_{Koptmin}$ is not true, and a branch is made back to the step 117 for the pre-heating. The warmup pulses lead to a head temperature that rises in steps. Otherwise, an error message ensues (in step 121) if the check in step 120 shows that a maximum of the optimum head temperature range is exceeded (then, $\vartheta_K < \vartheta_{Koptmax}$ is not true). The reduction of the warmup cycles occurs given a used ink cartridge. The invention has the advantage that the warmup cycles with ink spraying of a new installation can be avoided given ink cartridges that are not new. When a method for data follow-up is employed for the warmup cycles, the warmup data $U_{Popt}$ and t=0.75 μs stored in step 116 guarantee a warmup of the print head of a non-new ink cartridge in less than half the time, i.e. within a time of <30 s.

Given a used ink cartridge, the interrogation in step 111 can yield a prompt that a second condition should be newly entered. For example, the user can enter a user-related parameter $O_{user}$ by keyboard. Alternatively, the telepostage data center can enter a parameter $O_{user}$ into the postage meter machine in conjunction with a recrediting and after a successful check of the serial number of the ink cartridge, this parameter $O_{user}$ influencing the warmup time.

If the ink cartridge is a pirated product, then at least the warmup time can be lengthened. Ultimately, only a quality product whose characteristics are known should allow a fast warmup.

In another case, the telepostage data center TDC supplies and enters a parameter for a fast warmup on the basis of a client request. The parameter $O_{user}$ stands for a user-related reduction of the warmup time of the print head. The warmup data stored in step 116 deviate from the value of the optimum print pulse voltage $U_{Popt}$ with respect to the pulse amplitude. Given a lower pulse amplitude, the service life of the print head of the ink cartridge is lengthened, as is the warmup time of the print head. Given a higher pulse amplitude, the service life of the print head of the ink cartridge is shortened, as is the warmup time of the print head. Fundamentally, the pulse duration can also be varied in addition to the pulse amplitude. It is provided in one version that the parameter $O_{user}$ allows a fast start by varying the pulse duration according to the client request.

The parameters $n_P$ for warmup data of the used ink cartridge are known, i.e. can be queried, or are stored, and a branch is therefore made from step 112 to step 114 via step 113. At least one measurement of the ambient temperature $\vartheta_U$ now ensues and, potentially, the measurement of the current head temperature $\vartheta_K$. When all required parameters are known, then step 115 is reached. Either a corresponding table can be selected or the optimum warmup data are computationally generated according to an algorithm. It is possible to apply a mixed method with selection and generation:

a) The optimum warmup data $U_{Popt}(\vartheta_U)$ are taken from a stored table with measured and partly empirically determined data. The latter and the $2^{nd}$ conditions are then entered into an equation:

$$U_{Popt3}=F_3\{U_{Popt}(\vartheta_U), \vartheta_K, n_P, O_{user}\} \quad (3)$$

and the pulse duration amounts to t=0.75 μs or the equation reads:

$$U_{Popt4}=F_4\{U_{Popt}(\vartheta_U), \vartheta_K, n_P\} \quad (4)$$

and the pulse duration lies in the range 1.9 μs>t($O_{user}$)>0.75 μs and is selected in conformity with the customer request.

b) The optimum warmup data are computationally generated according to an algorithm for at least two tables: $U_{Popt1}=F_1\{(\vartheta_U), \vartheta_K\}$, $U_{Popt2}=F_2\{(\vartheta_U), \vartheta_K\}$. One of the tables, for example Table 2, is now available for at least one parameter $n_P$ or $O_{user}$, and $U_{Popt2}$ can be taken therefrom for a fast warmup.

The parameter $n_P$ refers to history-related data such as, for example, the ink remainder, the filling level, the number of frankings or the operating age since the initial installation or to the expiration date before which the ink should be used. A number of tables thus must be generated or compiled with empirically determined data. One table can then be selected from this number. The current second conditions are described by the ambient temperature $\vartheta_U$, the ink print head temperature $\vartheta_K$ and parameters $n_P$, $O_{user}$, and the control unit 14 calls the parameter $n_P$ dependent on the use of the ink cartridge and calls the parameter $O_{user}$ dependent on the selection made by the user for a shortened warmup cycle. Given employment of two ink cartridges, these are driven with different warmup data as a result of a different temperature-related or history-related data follow-up.

The invention is not limited to the present embodiments. Modifications are conceivable for generating or selecting a table before the step 116 is subsequently reached in order to store the identified, optimum warmup data allocated to a code or to the serial number of the ink cartridge.

Although modifications and changes may be suggested by those skilled in the art, it is the intention of the inventor to embody within the patent warranted hereon all changes and modifications as reasonably and properly come within the scope of his contribution to the art.

We claim as our invention:

1. A method for determining data for a warmup cycle of an ink jet printhead before operating said ink jet printhead comprising the steps of:

storing warmup data and data representing a first condition in a memory of an apparatus employing an ink jet printhead upon installation of an ink cartridge for said ink jet printhead in said apparatus, before a first use of said newly installed ink cartridge;

accumulating and storing parameter data for at least two second conditions for a fast start, executed in less than 30 seconds, of said ink jet print head during repeated use of said ink jet printhead said second conditions being selected from the group consisting of temperature-related data, history-related and user-related data;

determining warmup data for said second conditions from said parameter data and employing said warmup data for said second conditions in said fast start of said ink jet printhead;

uniquely allocating identification data to said ink cartridge;

before each use of said ink cartridge, interrogating said identification data and checking said identification data to authenticate said identification data;

and determining said warmup data for said fast start according to a first procedure if said ink cartridge is authenticated and according to a second procedure if said ink cartridge is not authenticated.

2. A method as claimed in claim 1 wherein the step of storing said parameter data comprises storing said parameter data in a table, and wherein the step of determining said warmup data comprises electronically accessing said table to retrieve said parameter data therefrom, and determining said warmup data from said retrieved data.

3. A method as claimed in claim 2 wherein the step of determining said warmup data comprises determining said warmup data by applying a computational algorithm to said parameter data.

4. A method as claimed as claim 1 comprising the additional step of entering a user-selected parameter into said apparatus, and warmup data comprises determining said warmup data from said parameter entered by said user, said temperature-related data and said user-related data.

5. A method as claimed in claim 1 comprising the step of operating said ink jet printhead with a voltage pulse having a pulse amplitude and a pulse duration, and comprising modifying said pulse amplitude in said fast start and maintaining said pulse duration at a constant value during said fast start, said constant value being shorter than a pulse duration when operating said ink jet printhead for printing.

6. A method as claimed in claim 1 comprising the additional steps of operating said ink jet print head with a voltage pulse having a pulse amplitude and a pulse duration, and modifying said pulse amplitude during said fast start dependent on said temperature-related data and said history-related data, and modifying said pulse duration during said fast start dependent on said user-related data.

7. A method as claimed in claim 1 wherein said second conditions comprise data representing ambient temperature, data representing temperature of said ink jet print head, a first parameter dependent on use of said ink cartridge, and a user-entered second parameter indicating selection of a shortened warmup cycle.

8. A method as claimed in claim 1 wherein said ink cartridge is a first ink cartridge, and comprising the additional steps of providing a second ink cartridge in said apparatus and determining different warmup data for said second ink cartridge, and operating said first ink cartridge in said fast start with said warmup data and operating said second ink cartridge in said fast start with said different warmup data.

9. A method as claimed in claim 8 comprising operating said first ink cartridge with a first voltage pulse having a pulse amplitude and a pulse duration, and operating said second ink cartridge with a second pulse having a pulse duration and a pulse amplitude, and comprising compensating for differences between said first ink cartridge and said second ink cartridge by modifying, in said fast start, said pulse duration of one of said first pulse and said second pulse, while maintaining said pulse amplitude of said first pulse and said second pulse equal.

* * * * *